US006435967B1

(12) United States Patent
Michlin

(10) Patent No.: US 6,435,967 B1
(45) Date of Patent: Aug. 20, 2002

(54) TAB MARKING SYSTEM

(75) Inventor: Irving R. Michlin, Millbrook, NY (US)

(73) Assignee: AmeriComm Direct Marketing, Inc., Roanoke, VA (US)

( * ) Notice: Subject to any disclaimer, the term of this patent is extended or adjusted under 35 U.S.C. 154(b) by 0 days.

(21) Appl. No.: 09/362,968

(22) Filed: Jul. 29, 1999

Related U.S. Application Data

(63) Continuation-in-part of application No. 08/862,068, filed on May 22, 1997, now abandoned.

(51) Int. Cl.[7] ..... B41L 1/20
(52) U.S. Cl. ..... 462/63; 283/36; 283/38
(58) Field of Search ..... 283/36, 37, 38, 283/39, 40, 42, 66.1, 115; 462/55, 63

(56) References Cited

U.S. PATENT DOCUMENTS

| | | | | | |
|---|---|---|---|---|---|
| 3,958,816 | A | * | 5/1976 | Remmey, III | 283/38 |
| 4,188,427 | A | * | 2/1980 | Grass | 428/41 |
| 4,505,497 | A | * | 3/1985 | Katzman | 283/81 |
| 5,011,189 | A | * | 4/1991 | Olson | 283/81 |
| 5,182,152 | A | * | 1/1993 | Ericson | 428/42 |
| 5,468,085 | A | * | 11/1995 | Kline | 402/79 |
| 5,641,182 | A | * | 6/1997 | Schwandt | 283/36 |
| 5,645,300 | A | * | 7/1997 | Hill | 283/81 |
| 5,687,904 | A | * | 11/1997 | Potter | 229/303 |
| 5,752,723 | A | * | 5/1998 | Robertson | 283/67 |
| 5,853,259 | A | * | 12/1998 | Murray, Jr. | 283/36 |

FOREIGN PATENT DOCUMENTS

| | | | | |
|---|---|---|---|---|
| WO | WO 98/17481 | * | 4/1998 | 281/42 |

* cited by examiner

*Primary Examiner*—A. L. Wellington
*Assistant Examiner*—Monica S. Carter
(74) *Attorney, Agent, or Firm*—Mintz, Levin, Cohn, Ferris, Glovsky and Popeo, P.C.

(57) ABSTRACT

A tab marking system for supplying discrete tabs provided with repositionable glue disposed adjacent first terminal ends thereof which may be adhered to multi-page documents to flag particular pages. The tab marking system comprises a first ply of paper having at least two discrete tabs die cut therein separated by a spacer and a second ply of paper disposed under the first ply covering at least a portion of the discrete tabs. A barrier coating is disposed on the second ply in facing relation to the repositionable glue to prevent adhesion of the repositionable glue to the second ply. Embodiments of the invention include an adhering agent disposed on the discrete tabs adjacent second terminal ends thereof to removably hold second terminal ends integral with the first ply of paper until removal of the tabs is desired.

20 Claims, 10 Drawing Sheets

TAB MARKING SYSTEM

This application is a continuation-in-part application under 37 CFR §1.53(b) of Ser. No. 08/862,068, filed May 22, 1997 now abandoned, and related to tab marking system.

BACKGROUND OF THE INVENTION

As is known, various types of techniques have been employed by readers of magazines, technical papers and other types of documents for marking off pages of interest. For example, one technique is to simply turn down the upper corner of a page of a multi-page document in order to return to that page after reading the document. Other techniques have employed the placing of paper clips on the edge of a document. Still others have employed Post-it® type tabs which project from the edge of a page to "flag" the page of interest. All of these techniques have some advantages and disadvantages.

For example, the least expensive technique tends to be one in which the upper corner of the page is simply folded over. However, since the folded over edge is not readily apparent when the document is closed, the "flagging" of the page may not be readily apparent to a user. The use of paper clips or Post-it® type tabs require a suitable supply of such materials from other sources.

SUMMARY OF THE INVENTION

Accordingly, it is an object of the invention to provide a tab marking system which is incorporated with the document to be read.

It is another object of the invention to be able to flag the pages of a document which are to be re-read in a simple manner.

It is another object of the invention to provide a ready supply of tab markers for the reader of a multi-page document.

Briefly, the invention is directed to the combination of a document having a plurality of pages and a tab marking system incorporated with the document for marking selected pages of the document. This tab marking system includes a first ply having a plurality of removable tabs, a second ply disposed under the first ply to cover over at least a portion of the tabs and a self-adhesive repositionable glue on each tab adjacent one end and facing the second ply for removably affixing a respective tab to a selected page of the document after removal of the tab from the first ply.

In one embodiment where the document is in the form of magazine or catalog having a cover sheet and a plurality of pages, the tab marking system may be incorporated as an insert sheet in the magazine, for example, between the cover and one of the pages. In this embodiment, as a reader of the magazine or catalog reads from page to page, a tab may be removed from the insert sheet and affixed to a page of interest in order to flag the page for later review. Several pages may be tabbed in the same manner by removing additional tabs from the insert sheet.

In another embodiment, the tab marking system may be incorporated in a wrapper about a multi-page document. In this embodiment, the wrapper may be of a sleeve type which can be readily removed from the document to permit reading of the pages of the document. As a page becomes of interest, a tab may be removed from the wrapper and applied to the edge of the page to flag the page for subsequent reading.

Typically, the self-adhesive glue which is used on the tabs is of a releasable nature so as to be peeled off from the tab marking system and applied to a page of a document in an adhesive manner. For example, one such glue is one sold under the trade name Craigstik 3991PLV and is sold as a repositionable adhesive with a chemical name of "water based adhesive" in a chemical family of "synthetic polymer dispersion". This glue is obtainable from the manufacturer, Craig Adhesives & Coatings Co., 80 Wheeler Point Road, Newark, N.J.

In order to avoid any adhesion of the self adhesive glue to the underlying ply, the second ply is provided with a barrier coating in facing relation to the glue. Any suitable type of barrier coating may be used in this regard. For example, a silicone-based barrier coating may be used although it has been found that some silicone based barrier coatings are not useable. The specific barrier or release coating which has been found to be advantageous is sold by Dow Corning Corporation under the designation SYL-OFF (R) 7676 release coating.

The tab marking system may also be used apart from the document. That is to say, the tab marking system may be handled as a unit from which tabs may be used for various purposes. For example, where the tabs are of a relatively small size, the tabs may be removed and used to mark the pages of a multi-page document as above. In other cases, the tabs may be of a larger size so as to allow writing thereon. As such, a tab may be removed and used in a similar manner to a conventional Post-It® type tab. Still further, the tabs may be personalized with variable data.

The tab marking system may be constructed in various formats. Basically, the tab marking system is comprised of a first ply of paper having a plurality of parallel lines of weakening to define a plurality of discrete tabs therebetween. In addition, a first line of weakening is disposed perpendicular to and common to the parallel lines of weakening to define a terminal end of each tab while a second line of weakening or gap is provided perpendicular to and common to the parallel lines of weakening to define a second terminal end of each tab. In either case, one end of the tab is provided with the self-adhesive glue while the other end of the tab is positioned so as to be manually grasped by the fingers of a user and peeled back from the overlying second ply of paper so that upon removal from the first ply, a discrete tab is available be affixed to a page of a document or any other substrate.

BRIEF DESCRIPTION OF THE DRAWINGS

These and other objects and advantages of the invention will become more apparent from the following description taken in conjunction with the accompanying drawings wherein.

DETAIL DESCRIPTION OF PREFERRED EMBODIMENTS

Figure 1:
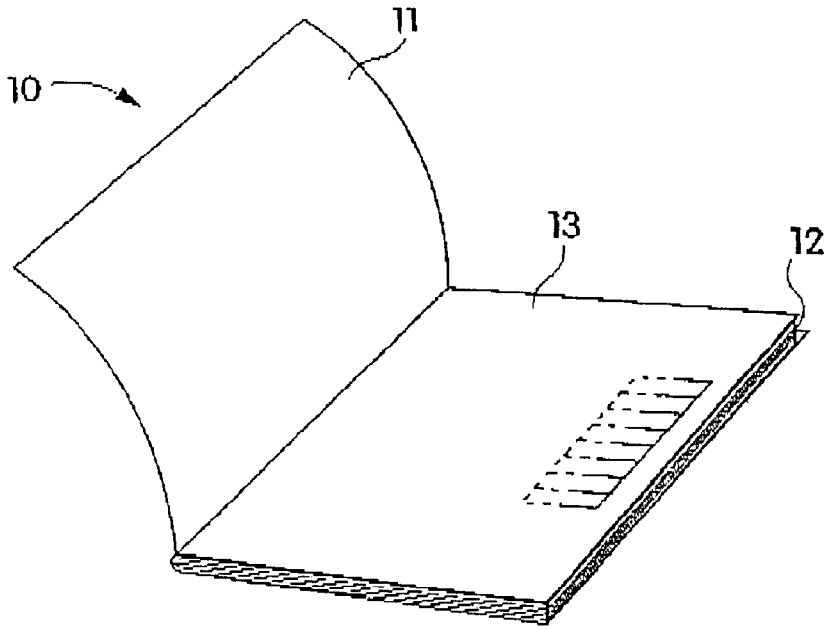
FIG. 1 illustrates a document having an insert sheet of removable tabs in accordance with the invention.

Referring to FIG. 1, a multi-page document 10, such as a magazine or catalog, is provided with a cover sheet 11 and a plurality of pages 12. As such, the document 10 is of conventional construction and need not be further described.

In accordance with the invention, a tab marking system 13 in the form of an insert sheet is incorporated with the document 10 for marking selected pages of the document 10. As illustrated in FIG. 1, the insert sheet 13 is provided between the cover 11 and the first inside page 12 of the document 10 in free standing relation to the pages 12. As illustrated in FIG. 1, the insert sheet 13 is of the same size as the pages 12 of the document 10. However, the insert sheet 13 may be positioned anywhere with the document 10.

Figure 2:
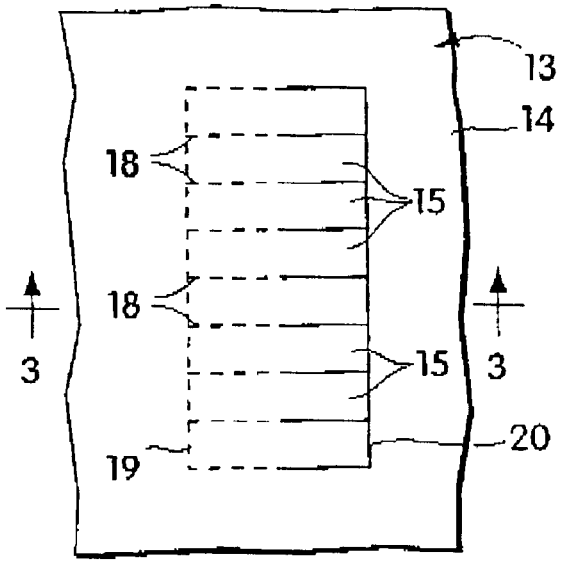
FIG. 2 illustrates a partial view of the insert sheet of FIG. 1.
Figure 3:
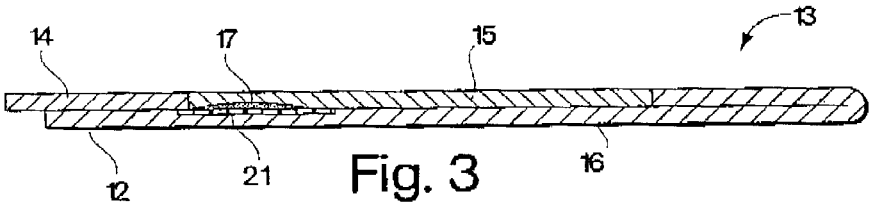
FIG. 3 illustrates a cross sectional view taken on line 3—3 of FIG. 2.

Referring to FIGS. 2 and 3, the insert sheet 13 has a first ply 14 including a plurality of removable tabs 15 and a second ply 16 disposed under the first ply to cover at least a portion of the tabs 15. As indicated, the second ply 16 is formed as a folded under portion of the first ply 14 and covers the entire surface of the movable tabs 15. Typically, the row of removable tabs 15 is positioned along the right-hand margin of the insert sheet 13, for example, being spaced approximately one quarter inch from the edge of the insert sheet 13.

As illustrated in FIG. 3, a self-adhesive glue 17 is disposed on the underside of each tab 15 adjacent one end in facing relation to the second ply 16. This self-adhesive glue 17 is for affixing a respective tab 15 to a selected page of the document 10 after removal of the tab 15 from the first ply 14.

Figure 2A:
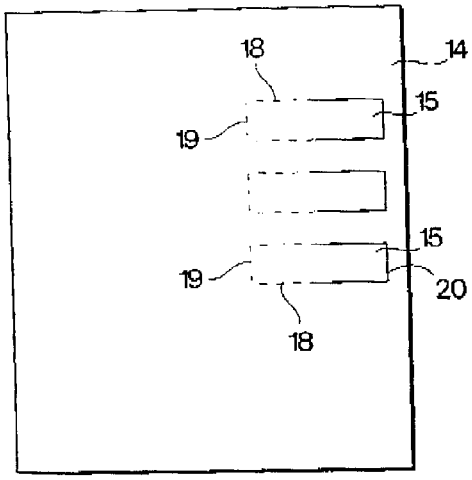
FIG. 2A illustrates a modified insert sheet in accordance with the invention.

As illustrated in FIG. 2, the tabs 15 are of elongated rectangular shape and are disposed parallel to each other. In addition, the tabs 15 are contiguous to each other with a line of weakening 18 (or a die cut) between each pair of contiguous tabs 15. In addition, there is a line of weakening 19 which is perpendicular to and common to the parallel lines of weakening 18 in order to define a terminal end of each tab. As indicated, the lines of weakening 18 may be formed by a slit followed by a perforated line while the line of weakening 19 is formed of a line of perforations. Alternatively as shown in FIG. 2A, the tabs 15 may be spaced apart from each other in order to impart a degree of rigidity to the portion of the insert sheet 13 from which the tabs are to be removed. For example, the tabs 15 may alternate with spacers which are integral with the remainder of the insert sheet 13. Also, for example, the spacers may be provided between every one, two or three sets of tabs 15.

As also indicated in FIG. 2, a second line of weakening 20 is provided perpendicular to and common to the parallel lines of weakening 18 to define a second terminal end of each tab. This line of weakening 20 is, however, of a continuous type so as to define a slit so that the right-hand terminal end, as viewed, can be readily peeled back from the remainder of the ply 14. Alternatively, a gap may be provided in the ply 14 to provide ready access to the end of each tab 15.

Referring to FIG. 3, a barrier coating 21 is provided on the second ply 16 in facing relation to the glue 17 on the tabs 15 in order to prevent adhesion of the glue 17 to the second ply 16. In this respect, it has been found desirable to place the glue 17 on the barrier coating 21 for subsequent adherence to the tabs 15 rather than to place the glue 17 directly on the tabs 15.

The insert sheet 13 may be constructed in other manners. For example, where the insert sheet 13 is to be inserted between interior sheets within a magazine or catalog, the insert sheet is provided with a fold-out portion along the right-hand side. This type of construction permits the insert sheet to act as a book mark when in the folded-in condition so that the user can readily locate the insert sheet within the magazine or catalog due to the 3-ply thickness of the insert sheet. Secondly, once the insert sheet has been located, the fold-out portion may be folded outwardly to the right from the document so that the removable tabs are readily available for use. In this respect, the fold-out portion of the insert sheet is made of two plies with the uppermost ply having the tabs incorporated therein and the lowermost ply acting as the protective ply under the tabs. In this respect, the fold-out portion is constructed in a manner as indicated in FIGS. 2 and 3.

Figure 4:
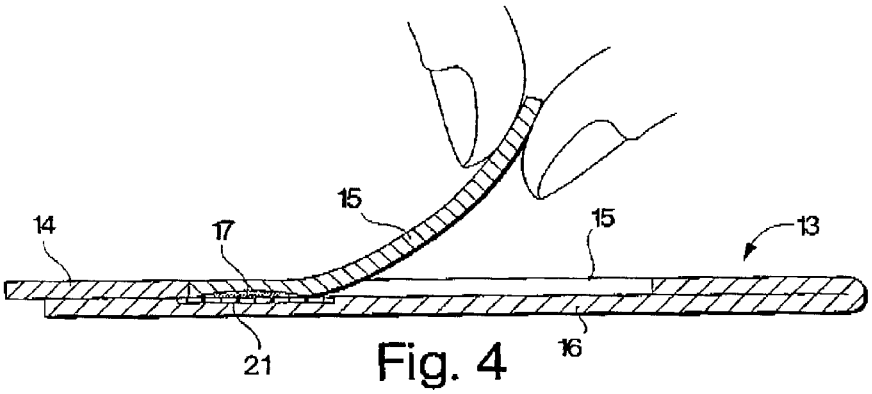
FIG. 4 illustrates a view similar to FIG. 3 during removal of a discrete tab in accordance is with the invention.
Figure 6:
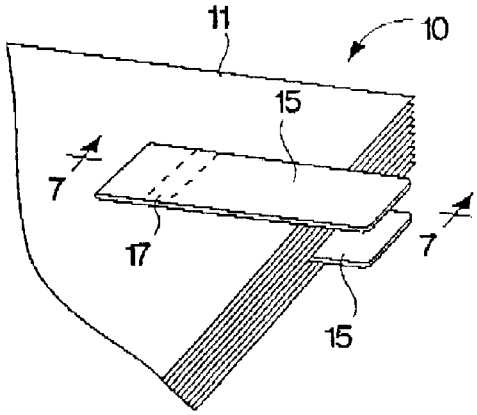
FIG. 6 illustrates a partial view of a plurality of tabs marking the pages of a document in accordance with the invention.
Figure 7:
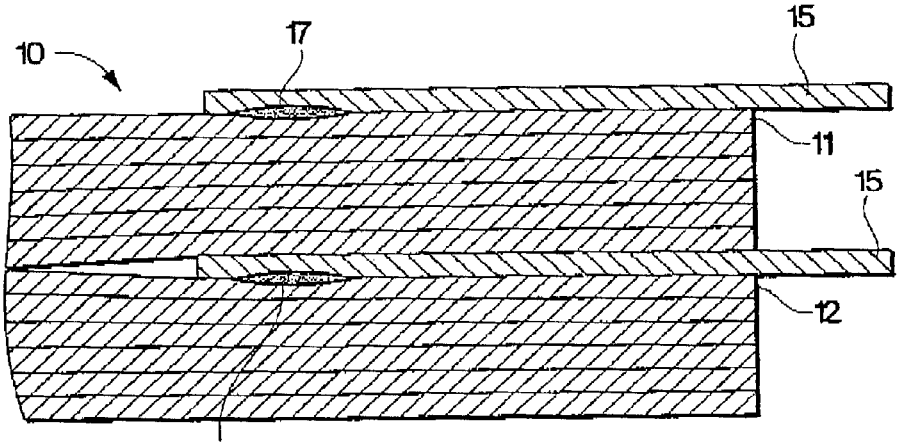
FIG. 7 illustrates a cross sectional view taken on line 7—7 of FIG. 6.

In order to use the tabs 15, as a reader reads through the pages of the magazine 10, a tab 15 is peeled back and removed from the insert sheet 13 in a manner as indicated in FIG. 4. That is to say, one end of a tab 15 is picked up by the fingers of the user and separated from the remaining tabs 15. Upon removal, the discrete tab 15 can be affixed to the cover 11 or other pages 12 of the document 10 as indicated in FIG. 6. In this respect, the self-adhesive glue 17 on the under side of the tab 15 is designated by a screened area. Additional tabs 15 can be removed in a similar fashion and applied to other pages 12 of the document as indicated in FIG. 6.

Figure 5:
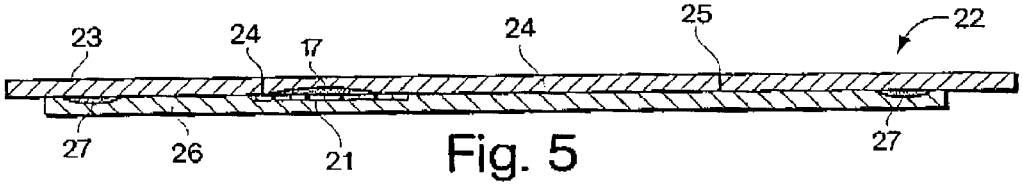
FIG. 5 illustrates a cross sectional view of a modified insert sheet in accordance with the invention.

Referring to FIG. 5, wherein like reference characters indicate like parts as above, the tab marking system may be constructed with a first ply 23 as above having lines of weakening or die cuts (not shown) to define a plurality of parallel tabs, as above, which can be separated from the ply 23 along lines of weakening 24, 25 at the terminal ends. In addition, the tab marking system has a separate protective ply 26 secured to the first ply 23 by two or more separate lines of adhesive 27. As above, a self-adhesive glue 17 is applied to the underside of each tab 15 at one end in facing relation to the ply 26 while a barrier coating 21 is applied to the top side of the ply 26 in facing relation to the adhesive 17 on the removable tabs 15.

Figure 8:
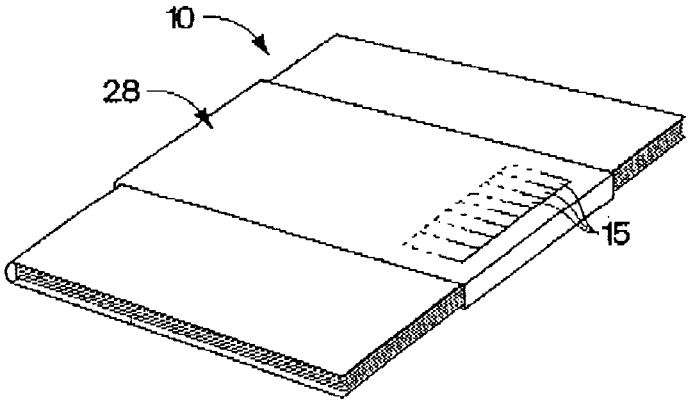
FIG. 8 illustrates a modified format of wrapper employing removable tabs for the marking of a document in accordance with the invention.

Referring to FIG. 8, wherein like reference characters indicate like parts as above, the tab marking system may be employed as a wrapper 28 about a document 10. Such a wrapper 28 may be constructed as indicated in FIG. 3 or as indicated in FIG. 5. The wrapper 28 may be sized as indicated in FIG. 8 to cover a minor portion of the document 10 or may be sized in a more conventional fashion to cover the entire surface of the document 10. In addition, the row of tabs 15 are disposed along one edge of the wrapper 28, for example, along the right-hand edge but may also be disposed centrally of the wrapper 28 or along another edge.

In the case where the wrapper 28 is of a size such as shown in FIG. 8, the wrapper is of two-ply construction so that there is an underlying ply which acts as the protective ply to cover over at least the adhesive portions of the tabs. In the case where the wrapping 28 is of the same size as the document 10, the wrapper may be formed as a sleeve which can be slid from the document. In this case, only the portion of the wrapper which lies over the front of the document need be provided with a protective ply to lie over at least the adhesive containing portions of the row of tabs. That is to say, the protective ply need not be co-extensive with the dimensions of the wrapper but may be a simple panel which is secured over the portions of the tabs which are to be protected.

In each of the illustrated embodiments, the ply which underlies the removable tabs may be provided with a preprinted message. In such cases, the message is uncovered in stepwise fashion in response to a sequential removal of the tabs.

The invention thus provides a tab marking system which is incorporated with the document to be read so that marking tabs are readily available for a reader to use. Further, since the tab marking system can be incorporated as part of the document, the provider of the document may also include advertising media or printing which can be customized to the documents or the reader or both.

The invention also provides a tab marking system which can be incorporated into a catalog to aid a user in marking pages having items which are desired to be ordered by the user. After marking various papers of the catalogs from which items are to be ordered, an order form which is typically incorporated in the catalog may then be completed by the user to order the items desired. In this respect, the insert sheet which acts as the carrier for the tabs may also be constructed to serve as the carrier for an order form. Likewise, a return envelope which is typically incorporated with the order from can also be incorporated with the insert sheet. That is to say, a single insert can be provided to include the removable tabs, the order form and the return envelope.

Figure 9:
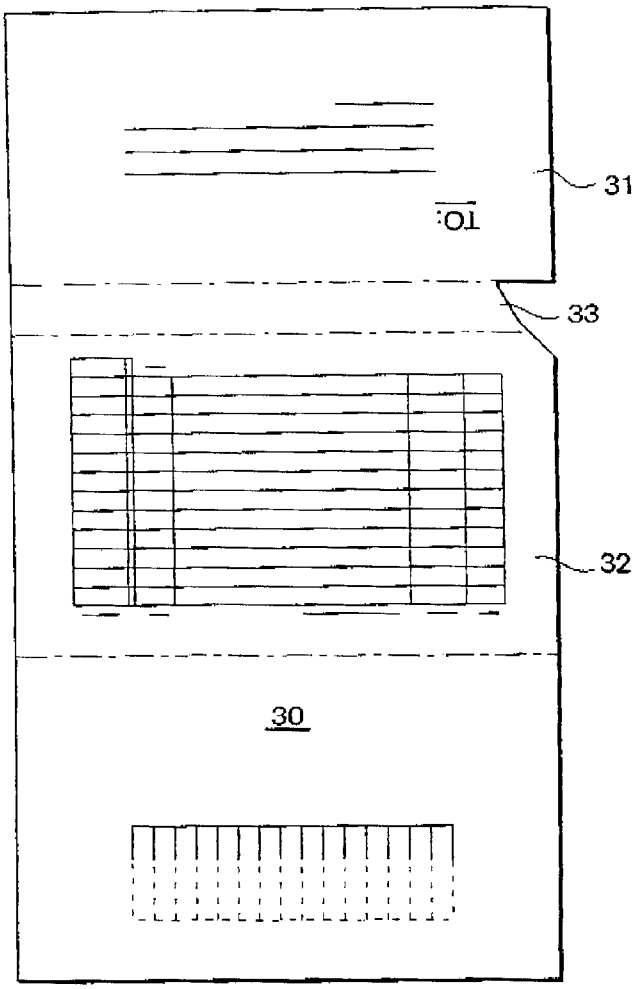
FIG. 9 illustrates a modified tab marking system employed with a return envelope and order form in accordance with the invention.

Referring to FIG. 9, a tab marking system 30 may be integrated with a return envelope 31 and an order form 32. As illustrated, the return envelope 31 is constructed in a conventional fashion with a front ply, a back ply which forms a pocket with the front ply, a flap 33 extending from the front ply for closing over the pocket and a glue (not shown) on the flap 33 for sealing the plys together to close the pocket. The order form 32 is generally of rectangular construction and is secured to the return envelope 31 via a line of weakening such as a line of perforations. Both the return envelope 31 and the order form 32 can be provided with various types of data to permit a user to order goods or services by completing the order form 32 with the necessary information and thereafter separating the order form 32 from the return envelope 31 along the line of perforations and then folding and stuffing the order form 32 into the return envelope 31.

As indicated, the tab marking system 30 is secured to the order form 32 along a line of weakening such as a line of perforations. Otherwise, the tab marking system 30 is constructed as above to have a first ply of paper with a plurality of discrete tabs 15 removably mounted therein and a second ply of paper (not shown) disposed under the first ply to cover over at least a portion of the tabs 15. As above, a self-adhesive repositionable glue is provided on each tab 15 adjacent one terminal end which faces the second ply of paper.

Figure 10:
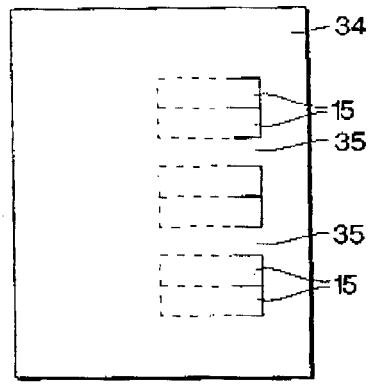
FIG. 10 illustrates a tab marking system in the form of a single sheet or unit in accordance with the invention.

The integrated construction of tab marking system, return envelope and order form can be utilized as such or may be incorporated into a catalog or the like. Referring to FIG. 10, the tab marking system 34 may also be used separately from a catalog, magazine or the like. That is to say, the tab marking system 34 may be made so as to be employed as a self-contained unit. In such a case, one or more tab marking systems 34 may be provided to a user so that tabs 15 may be removed from a respective marking system for placement, for example, as markers in a catalog, magazine or other multi-ply document. Likewise, the tabs 15 may be sized to readily receive writing or printing with the tabs then being removed for affixation to other substrates, such as a message board, telephone and the like for displaying a message.

As also shown in FIG. 10, the tabs 15 may be separated in pairs by spacers 35 which are integral with the remainder of the marking system 34. Alternatively, the spacers 35 may alternate with the tabs 15 or may be disposed between every three such tabs 15 and the like.

Still further, the tabs may be provided with personalized messages, for example in a preprinted form.

Each tab may be of a rectangular construction such as shown in FIGS. 1 and 2 to function as a tab marking device. Alternatively, each tab may be of square shape of a large rectangular shape so as to provide a surface to receive written or printed indicia.

Referring to FIGS. 11A–I, a further embodiment of the tab marker system comprises a first ply of paper 14 having at least two discrete tabs 15 die cut from and integral with the first ply of paper 14 and a second ply of paper 16 covering at least a portion of the tabs 15. The discrete tabs 15 are defined by lines of weakening separated by a spacer 50 integral with the first ply 14. Each tab 15 is defined by a first and a second parallel die cut line of weakening 18 and a third die cut line of weakening 19 perpendicular and common to a terminal portion of the first and the second parallel die cut lines of weakening 18 to define a first terminal end 40. A fourth die cut line of weakening 20 perpendicular and common to an opposite terminal portion of the first and second parallel die cut lines 18 defines a second terminal end 41. The embodiment shown in FIGS. 11A–C includes repositionable glue 17 disposed on each tab 15 adjacent the first terminal end 40 and in facing relation to the second ply 16. A barrier or release coating 21 is disposed on the second ply 16 in facing relation to the first ply 14 and the repositionable glue 17 to prevent adhesion of the glue to the second ply 16.

Figure 11A:
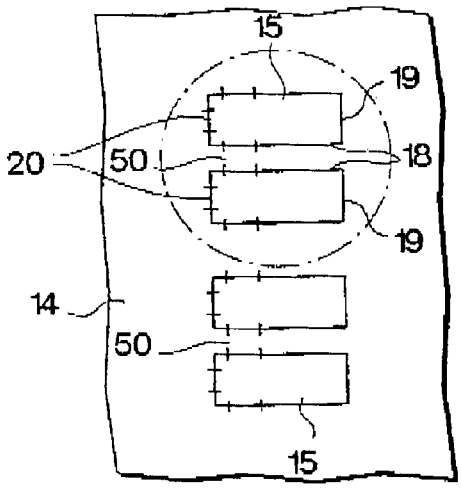
FIG. 11A illustrates removable tabs with perforations along and adjacent second terminal ends in accordance with the invention.
Figure 11B:
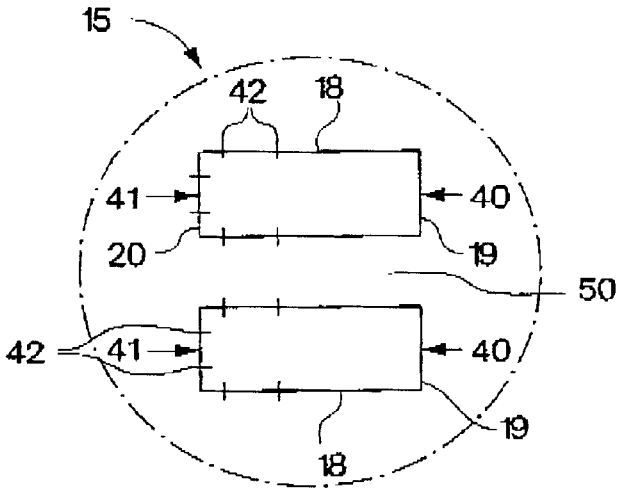
FIG. 11B is an enlargement of removable tabs illustrated in FIG. 11A.

The absence of glue on a portion of the tabs 15 adjacent each second terminal end 41 permits the second terminal end 41 of each tab to be readily lifted up and peeled back from the first ply 14 by the fingers of the user for removal. The second terminal end 41 is, thus, susceptible to inadvertent lifting up and peeling away from the first ply 14, particularly when the tab marker system is being printed or inserted into a catalog or magazine or distributed by mail to users. As shown in FIGS. 11A and 11B, perforations 42 are disposed along a portion of each of the first and second parallel die cut lines 18 adjacent each second terminal end 41 to ensure the second terminal end 41 of each tab remains integral with the spacer 50 and does not lift up and peel away from the first ply when removal of the tab 15 is not desired. As shown in FIGS. 11A and 11B, perforations 42 are disposed along each second terminal end 41 to maintain the second terminal end 41 integral the first ply 14 until such time as it is desired to remove the tabs 15.

Figure 11C:
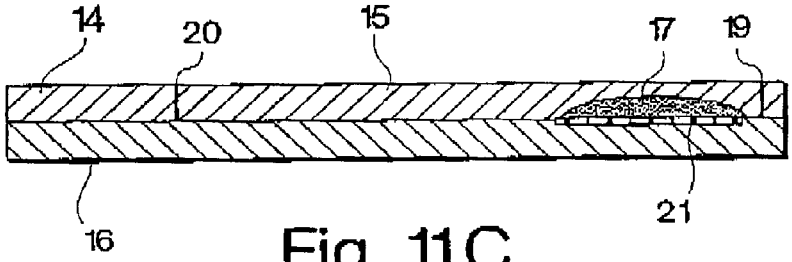
FIG. 11C illustrates a cross sectional view of removable tabs of FIG. 11B.
Figure 11D:
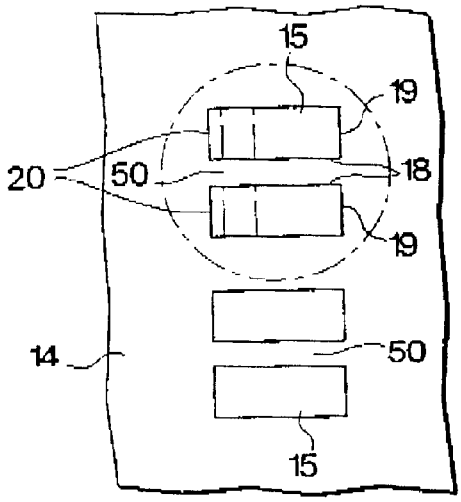
FIG. 11D illustrates removable tabs with fugitive glue adjacent second terminal ends in accordance with the invention.
Figure 11E:
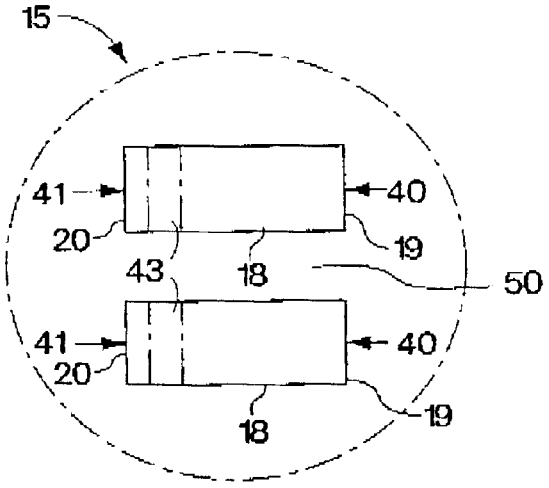
FIG. 11E is an enlargement of removable tabs illustrated in FIG. 11D.
Figure 11F:
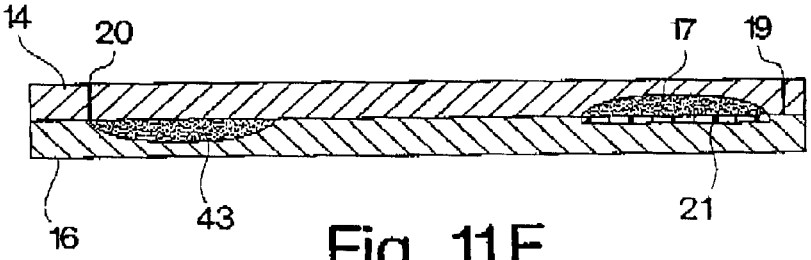
FIG. 11F illustrates a cross sectional view of removable tabs of FIG. 11E.

FIGS. 11D–F illustrate another embodiment of the invention which includes at least two discrete tabs 15 with each tab similarly defined as the embodiment of FIGS. 11A–C by the spacer 50 and lines of weakening 18, 19, 20 with respositionable glue 17 and the barrier coat 21 disposed adjacent the first terminal end 40. FIGS. 11E and 11F illustrate a coating of fugitive glue 43 disposed on the second ply 16 adjacent the second terminal end 41 and in facing relation to the first ply 14 of each tab 15 to ensure that the second terminal end does not lift up and peel away from the second ply 16 when removal of the tabs 15 is not desired. When the tabs 15 are peeled away from the first ply 14, the fugitive glue 43 remains on the second ply 16, leaving the portion of the tabs 15 adjacent the second terminal end 41 glue-free.

Figure 11G:
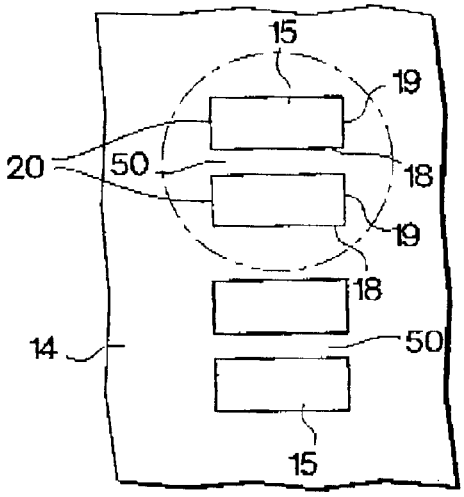
FIG. 11G illustrates removable tabs with barrier glue adjacent second terminal ends in accordance with the invention.
Figure 11H:
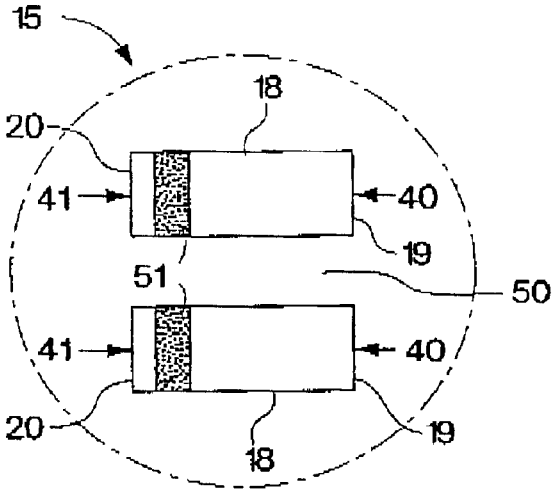
FIG. 11H is an enlargement of removable tabs illustrated in FIG. 11G.
Figure 11I:
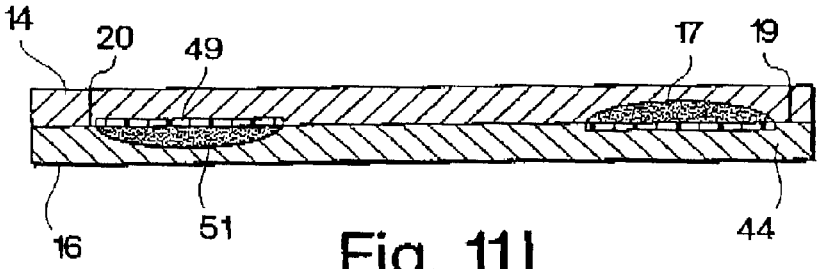
FIG. 11I is a cross sectional view of removable tabs of FIG. 11H.

Still another embodiment of the invention shown in FIGS. 11G–I includes at least two discrete tabs 15 defined by the spacer 50 and lines of weakening 18, 19 20 as in the embodiments of FIGS. 11A–F with repositionable glue 17 and the barrier coat 21 disposed on each tab 15 adjacent the first terminal end 40. Repositionable glue 51 is additionally disposed on the second ply 16 in facing relation to the discrete tabs 15 adjacent the second terminal end 41 of each discrete tab 15. The repositionable glue 51 ensures that the second terminal end 41 does not lift up and peel away from the first ply 14 when removal of the tabs 15 is not desired. A barrier coat 49 is disposed on the discrete tabs 15 in facing relation to the repositionable glue 51 to prevent the repositionable glue 51 from adhering to the discrete tabs 15 and to permit the second terminal end 41 to be lifted up and peeled back for removal of a tab 15 when desired.

Figure 12:
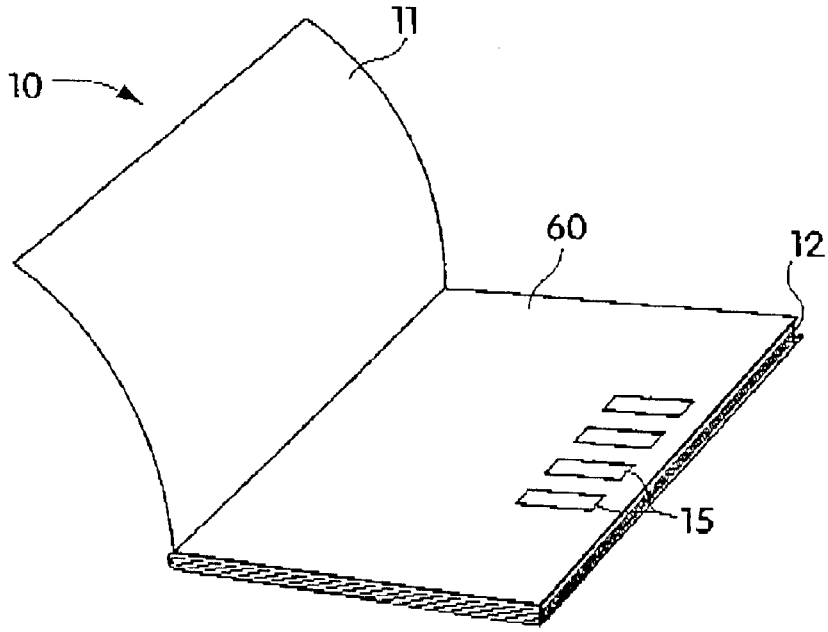
FIG. 12 illustrates a document having an insert sheet of removable tabs in accordance with the invention.
Figure 14:
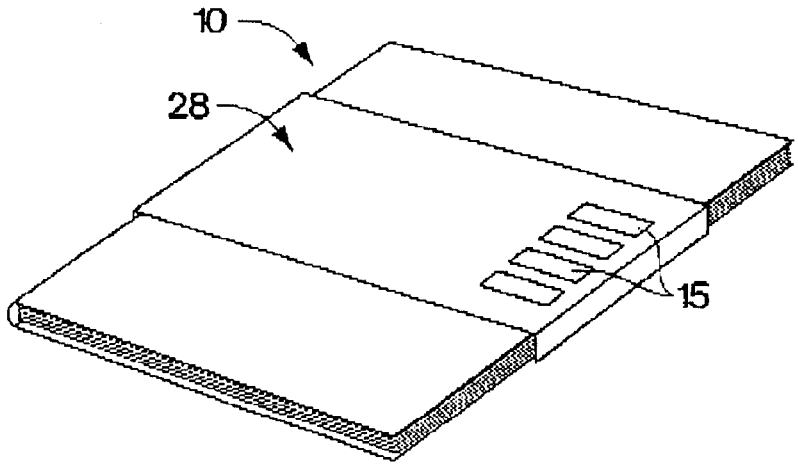
FIG. 14 illustrates a modified format of wrapper employing removable tabs for the marking of a document in accordance with the invention.
Figure 13:
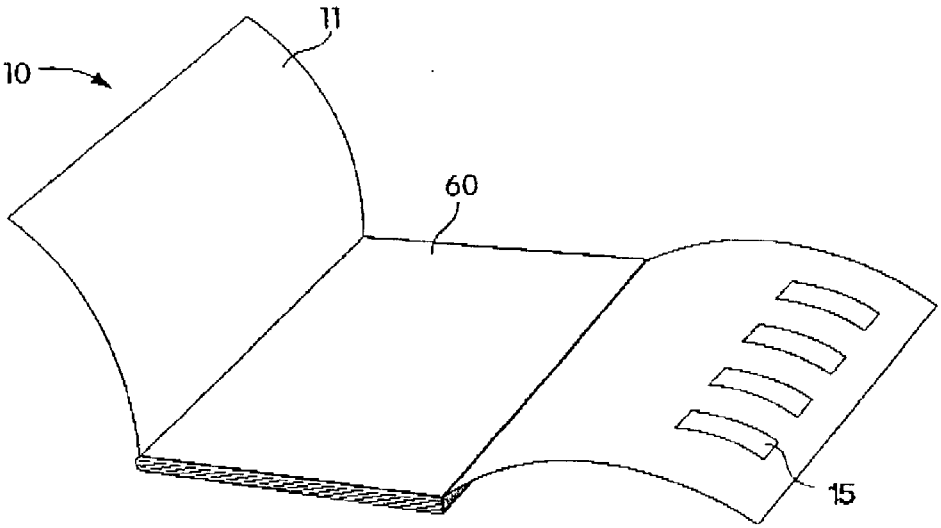
FIG. 13 illustrates an insert sheet of removable tabs with a fold-out portion in accordance with the invention.
Figure 15:
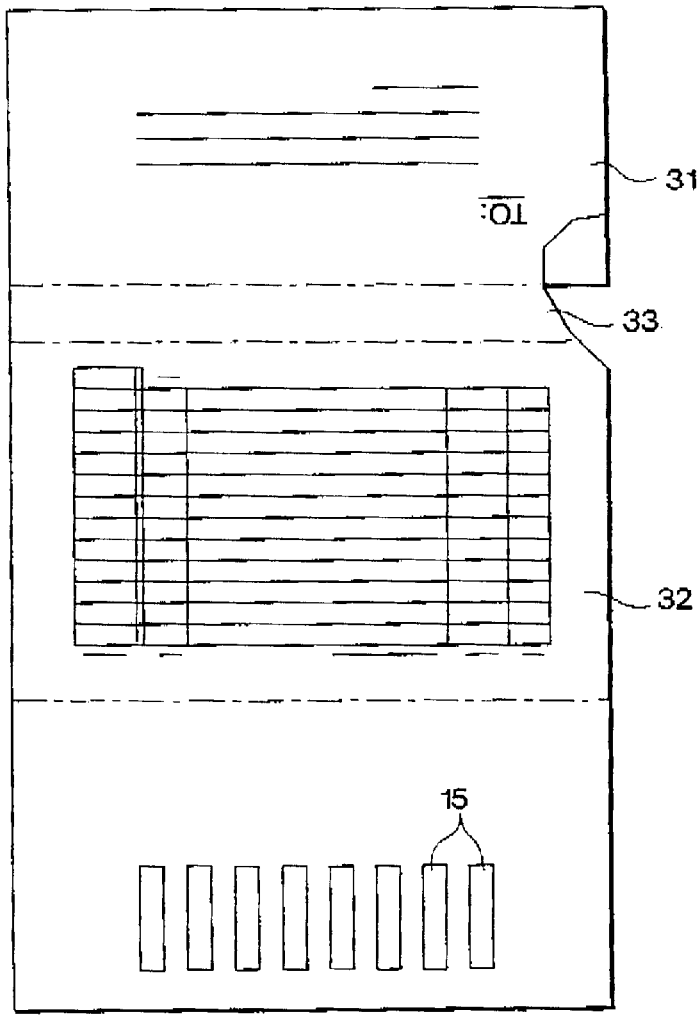
FIG. 15 illustrates a modified tab marking system employed with a return envelope and order form in accordance with the invention.

As shown in FIG. 12, the embodiments of FIGS. 11A–I may be used as an insert sheet 60, similar to the insert sheet 13 of FIG. 1, and incorporated between sheets of a document or pages of a magazine or catalog. The insert sheet 60 may also comprise a fold-out portion removably connected to the first ply 14, as illustrated in FIG. 13 and used as a book mark. As shown in FIG. 14, the embodiments of FIGS. 11A–I may be integral a document wrapper or magazine wrapper similar to the embodiment of FIG. 8. In addition, as shown in FIG. 15, the embodiments of FIGS. 11A–I may be integrated with the return envelope 31 and the order form 32 similar to the embodiment of FIG. 9.

Figure 16:
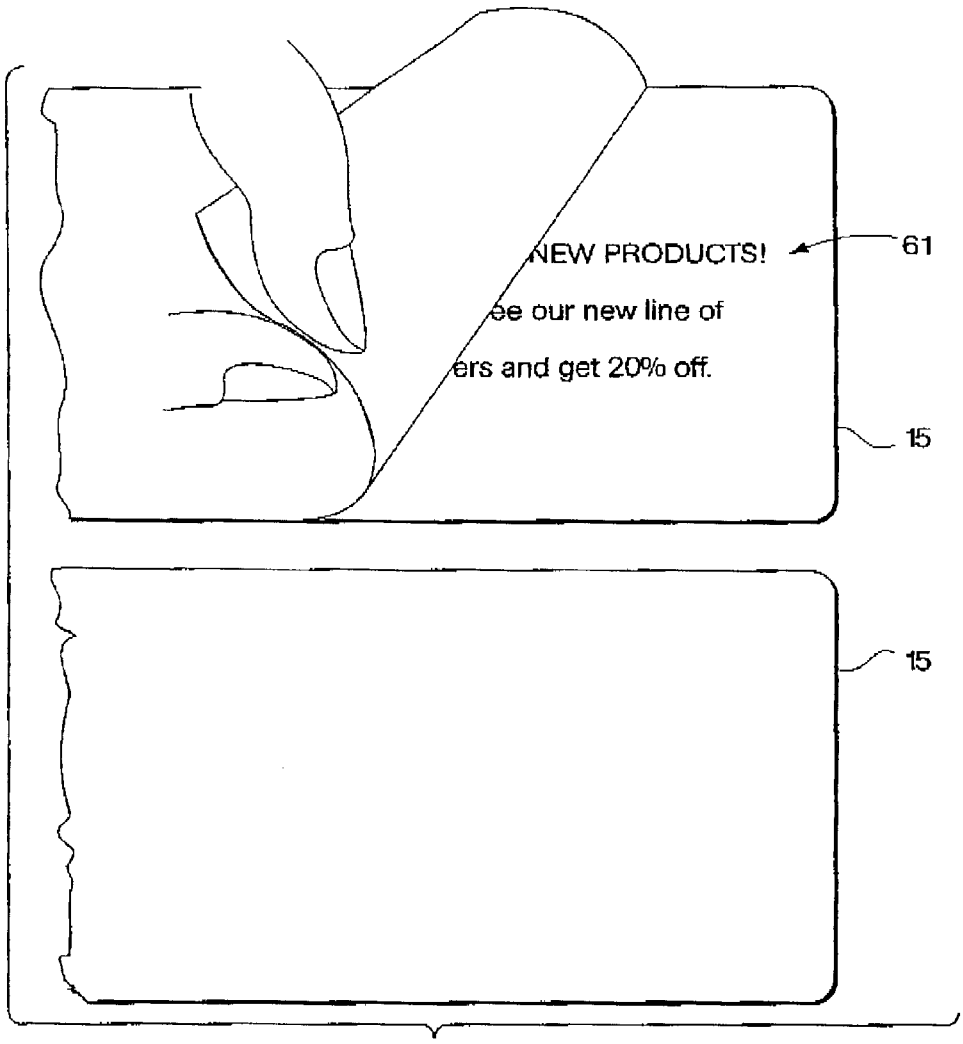
FIG. 16 illustrates preprinted messages underlying removable tabs in accordance with the invention.

In each embodiment of FIGS. 11A–I, at least a portion of the second ply 16 underlying the tabs 15 may be provided with a preprinted message 61 which is uncovered in response to removal of at least one of the tabs 15, as shown in FIG. 16.

The tabs shown in FIGS. 11A–I may be of various dimensions and shapes including, but not limited to, rectangular shape, as shown, or square shape. Larger sized tabs may readily receive handwritten messages, indicia and other information.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A tab marking system comprising:

a first ply of paper having at least two discrete tabs removably mounted therein and separated by a spacer integral with the first ply of paper, each discrete tab defined by first and second parallel die cut lines of weakening and a third die cut line of weakening perpendicular and common to a terminal portion of the first and second parallel die cut lines to define a first terminal end and a fourth die cut line of weakening perpendicular and common to an opposite terminal portion of the first and second parallel die cut lines to define a second terminal end;

a second ply of paper disposed under the first ply of paper to cover at least a portion of each discrete tab;

a repositionable glue disposed only on a portion of each discrete tab adjacent to the first terminal end thereof and in facing relation to the second ply of paper; and an adhering agent disposed only adjacent to the second terminal end of each discrete tab to removably hold the second terminal end and a portion of each discrete tab adjacent to the terminal end integral with the first ply.

2. The tab marking system of claim 1, wherein the repositionable glue is a water-based adhesive formed of a synthetic polymer dispersion characterized as being removably adherent to a substrate.

3. The tab marking system of claim 1, further comprising a barrier coating on the second ply of paper in facing relation to the repositionable glue of each discrete tabs to prevent adhesion of the repositionable glue to the second ply.

4. The tab marking system of claim 1, wherein the adhering agent comprises at least two perforations, one of at least two perforations being disposed along a portion of one of the first or second parallel die cut lines of weakening adjacent the second terminal end of each discrete tab.

5. The tab marking system of claim 4, further comprising at least one perforation disposed along the fourth die cut line of weakening which defines the second terminal end of each discrete tab.

6. The tab marking system of claim 1, wherein the adhering agent comprises fugitive glue disposed on the second ply of paper adjacent to the second terminal end and in facing relation to each discrete tab.

7. The tab marking system of claim 1, wherein the adhering agent comprises a combination of:

a repositionable glue disposed on the second ply of paper in facing relation to each discrete tab and adjacent to the second terminal end thereof; and a barrier coating disposed on the first ply of paper adjacent to the second terminal end and in facing relation to the repositionable glue to prevent adhesion of the repositionable glue to the first ply.

8. The tab marking system of claim 1, wherein the second ply of paper is a folded-under portion of the first ply of paper.

9. The tab marking system of claim 1, wherein the second ply of paper has a preprinted message underlying at least a portion of one of the discrete tabs whereby the message is uncovered in response to removal of one of the discrete tabs.

10. The tab marking system of claim 1, wherein the first ply of paper is inserted in a document having a plurality of pages.

11. The tab marking system of claim 10, wherein the first ply of paper is disposed in free-standing relation to the plurality of pages of the document.

12. The tab marking system of claim 10, further comprising a fold-out portion removably connected to the first ply of paper which folds outwardly from the first ply and defines a 3-ply thickness.

13. The tab marking system of claim 10, wherein the second ply of paper has a preprinted message underlying at least a portion of one of the discrete tabs whereby the message is uncovered in response to removal of one of the discrete tabs.

14. The tab marking system of claim 1, wherein the first ply of paper is integral a wrapper sleeve which receives and envelopes a document having a plurality of pages.

15. The tab marking system of claim 14, wherein the second ply of paper has a preprinted message underlying at least a portion of one of the discrete tabs whereby the message is uncovered in response to removal of one of the discrete tabs.

16. The tab marking system of claim 1, further comprising a return mailer having a pocket therein;

an order form removably connected to the return mailer for stuffing into the pocket of the return mailer; and wherein one of the return mailer and the order form is removably connected to the first ply of paper.

17. The tab marking system of claim 16, wherein the first ply of paper is inserted in a document having a plurality of pages.

18. The tab marking system of claim 16, wherein the first ply of paper is disposed in free-standing relation to the plurality of pages of the document.

19. The tab marking system of claim 16, wherein the second ply of paper has a preprinted message underlying at least a portion of the one of the discrete tabs whereby the message is uncovered in response to removal of one of the discrete tabs.

20. The tab marking system of claim 1, wherein the discrete tabs comprise dimensions to receive handwritten and printed indicia and information.

* * * * *

UNITED STATES PATENT AND TRADEMARK OFFICE

CERTIFICATE OF CORRECTION

PATENT NO. : 6,435,967 B1
DATED : August 20, 2002
INVENTOR(S) : Michlin

It is certified that error appears in the above-identified patent and that said Letters Patent is hereby corrected as shown below:

Title page,
Item [73], Assignee, please delete "AmeriComm Direct Marketing, Inc."

Signed and Sealed this

Sixteenth Day of September, 2003

JAMES E. ROGAN
*Director of the United States Patent and Trademark Office*